US006848765B1

(12) United States Patent
Cleveland

(10) Patent No.: US 6,848,765 B1
(45) **Date of Patent: *Feb. 1, 2005**

(54) END-OF-PAGE ADVANCE-DISTANCE DECREASE, IN LIQUID-INK PRINTERS

(76) Inventor: Lance Cleveland, 14049 Via Corsini, San Diego, CA (US) 92128

( * ) Notice: Subject to any disclaimer, the term of this patent is extended or adjusted under 35 U.S.C. 154(b) by 0 days.

This patent is subject to a terminal disclaimer.

(21) Appl. No.: 08/828,933

(22) Filed: Mar. 28, 1997

Related U.S. Application Data

(63) Continuation of application No. 08/056,633, filed on Apr. 30, 1993, now Pat. No. 5,677,716.

(51) Int. Cl.[7] ..... B41J 13/14
(52) U.S. Cl. ..... 347/16; 347/104; 400/645
(58) Field of Search ..... 347/16, 104, 37, 347/14; 400/642, 645

(56) References Cited

U.S. PATENT DOCUMENTS

| | | | | |
|---|---|---|---|---|
| 4,728,963 A | | 3/1988 | Rasmussen et al. | 346/25 |
| 4,748,453 A | | 5/1988 | Lin | 101/420 |
| 4,965,593 A | | 10/1990 | Hickman | 346/140 R |
| 5,000,597 A | | 3/1991 | Kilb | 400/636 |
| 5,079,571 A | | 1/1992 | Eriksen | 271/209 |
| 5,646,667 A | * | 7/1997 | Broder et al. | 347/104 |

FOREIGN PATENT DOCUMENTS

| | | | |
|---|---|---|---|
| DE | 1 431 742 | 4/1976 | B41J/13/24 |
| DE | 9 115 445 | 1/1993 | B41J/13/00 |
| EP | 0 517 520 | 12/1992 | B41J/2/205 |
| EP | 0 530 777 | 3/1993 | B41J/13/10 |

* cited by examiner

*Primary Examiner*—Craig A. Hallacher

(57) ABSTRACT

Two printing-medium guide systems restrain the medium. One is in an area upstream (along the direction of medium advance) from the pen, and extending laterally across the width of the medium except in one or more regions that are laterally near the engagement of a print-medium advancing device. The other guide system is disposed laterally from the pen, and extends laterally across the medium only in one or more regions that are laterally near the engagement of the advancing device. Preferably a human-actuable control selects a print-medium width, and shifts at least one bifurcation of the second guide system. A tensioning system, longitudinally beyond the marking head from the medium advancing device, and generally aligned laterally with that device, tensions the medium away from the advancing device to hold the medium taut at the pen. Preferably the advancing and tensioning devices are very closely spaced upstream and downstream, respectively, from the pen operating zone. When tensioned, the medium moves a normal distance through the apparatus at each operation of the advancing device; but after a trailing edge of the medium passes the advancing device (so that the medium is advanced only by the tensioner and is no longer tensioned), the advance distance is decreased (preferably by about half).

14 Claims, 6 Drawing Sheets

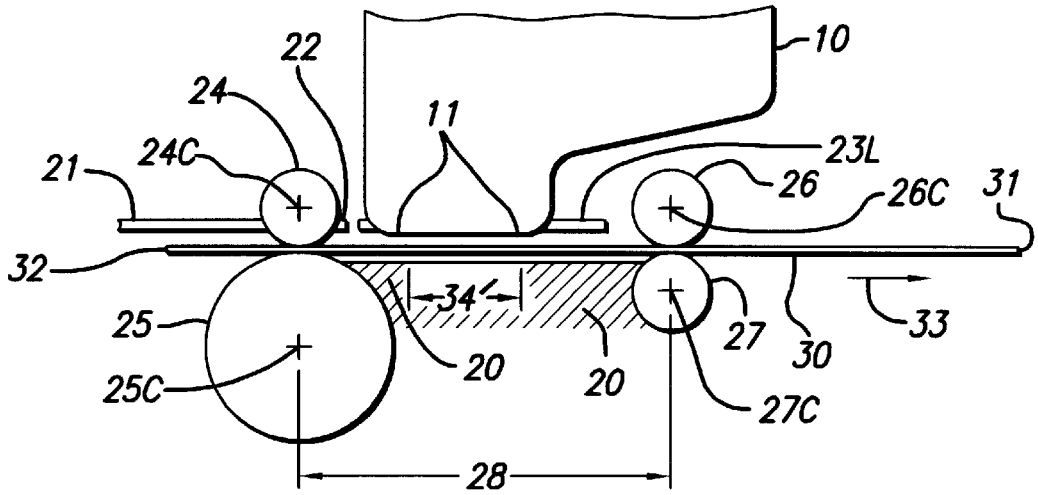
FIG. 1
FIG. 2
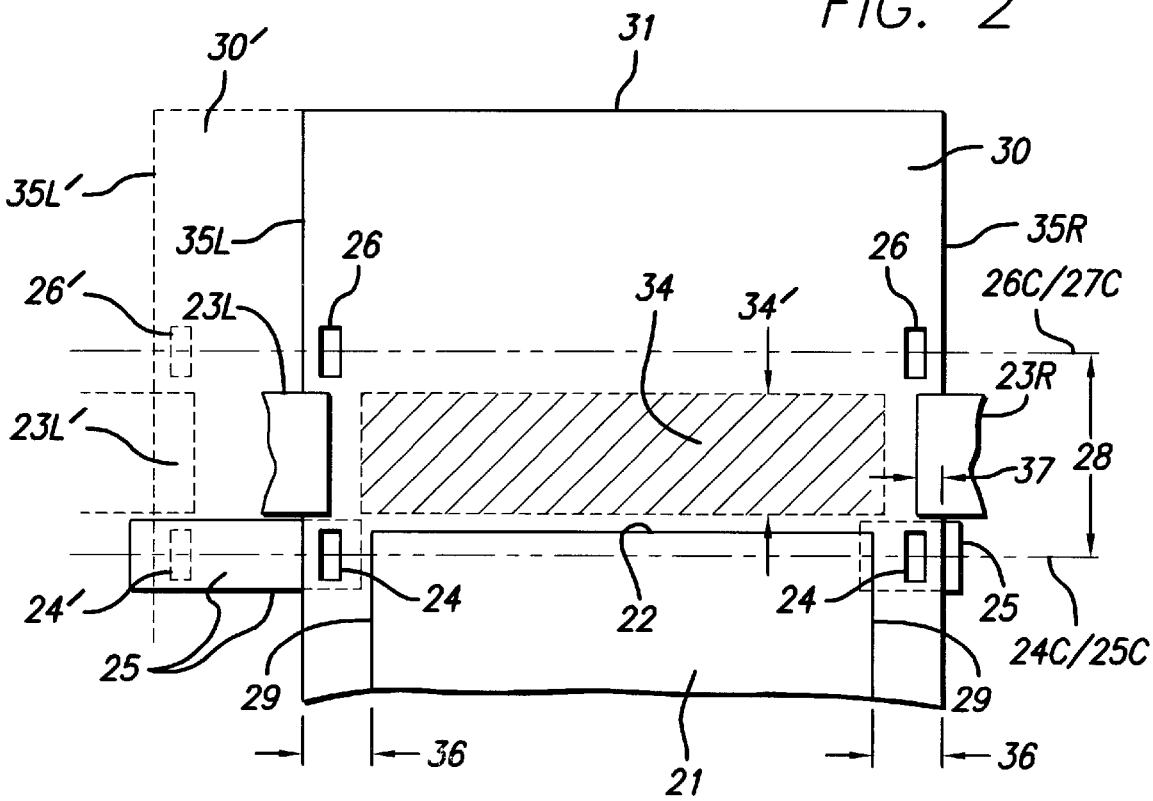

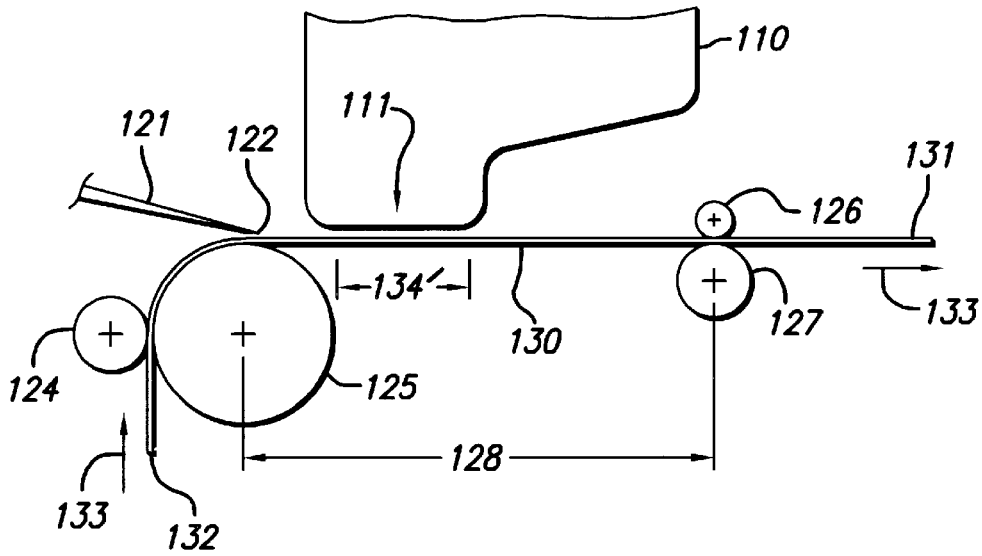
FIG. 4
PRIOR ART
FIG. 5
PRIOR ART
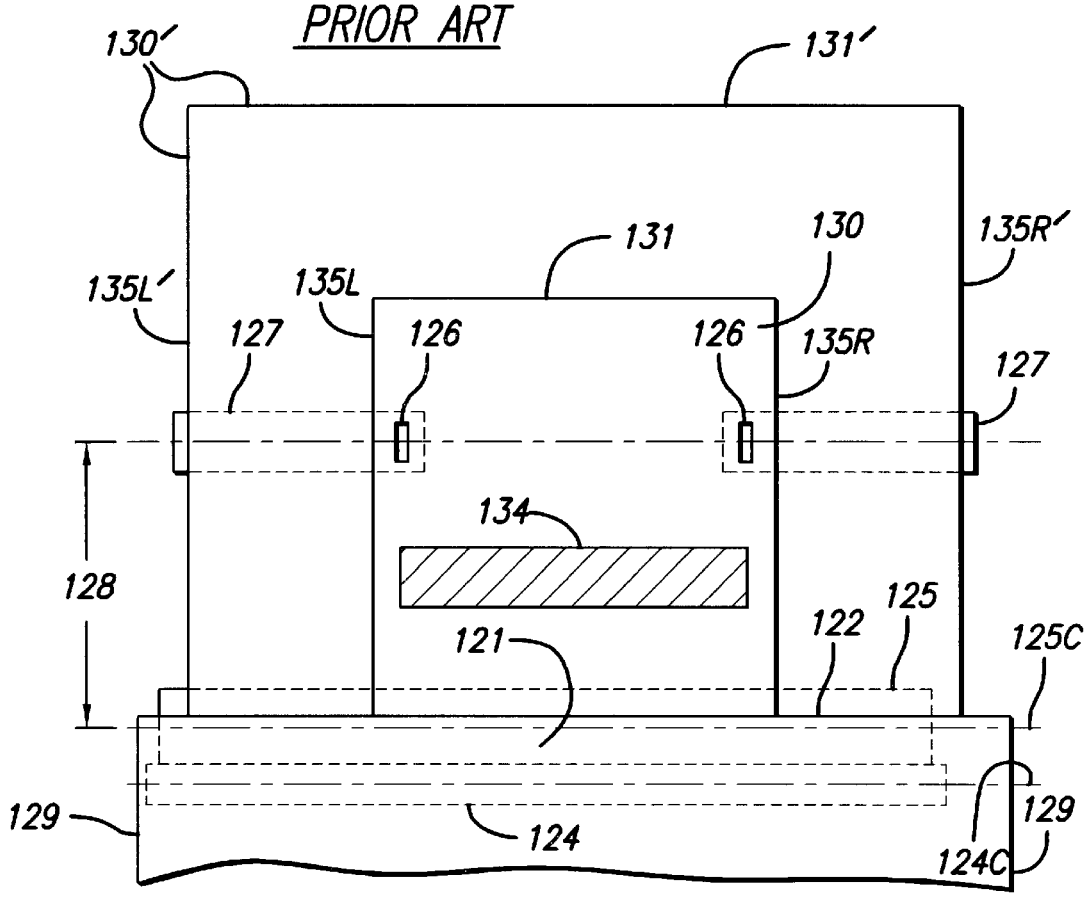

• SWEEP ROTATION
• NO ADVANCE

• 3-PASS NORMAL MODE
• 32-NOZZLE ADVANCE
• 96 NOZZLES PRINTING
• SPACE ROTATION

• HANDOFF ZONE
• TRANSITION TO 16-NOZZLE ADVANCE
• 48 NOZZLES PRINTING
• SPACE ROTATION

• NO ADVANCE

END-OF-PAGE ADVANCE-DISTANCE DECREASE, IN LIQUID-INK PRINTERS

RELATED PATENT DOCUMENTS

This is a continuation of application Ser. No. 08/056,633 filed on Apr. 30, 1993 now U.S. Pat. No. 5,677,716.

Two closely related documents are other, coowned U.S. utility-patent applications filed in the United States Patent and Trademark Office substantially contemporaneously with this document—and also hereby incorporated by reference in its entirety into this document. One is in the names of Ronald A. Askeland et al., and entitled "INKING FOR COLOR-INKJET PRINTERS, USING NONINTEGRAL DROPS, MEDIA-DEPENDENT INKING, OR MORE THAN 2 DROPS/PIXEL"—and subsequently assigned U.S. patent application Ser. No. 08/056,263, and issued as U.S. Pat. No. 5,485,180 on Jan. 16, 1996. Another such document is in the names of Gregory D. Raskin et al., and entitled "DIRECTION-INDEPENDENT ENCODER READING; POSITION LEADING & DELAY, & UNCERTAINTY TO IMPROVE BIDIRECTIONAL PRINTING"—and subsequently assigned U.S. patent application Ser. No. 08/055,650, and issued as U.S. Pat. No. 5,426,475 on Jun. 20, 1995.

BACKGROUND

1. Field of the Invention

This invention relates generally to machines and procedures for printing text or graphics on printing media such as paper, transparency stock, or other glossy media; and more particularly to a scanning thermal-inkjet machine and method that construct text or images from individual ink spots created on a printing medium, in a two-dimensional pixel array. The invention employs print-mode techniques to minimize image distortion.

A pen or other marking element or head that scans across the medium. The invention is particularly beneficial in printers that operate by the thermal-inkjet process—which discharges individual ink drops onto the printing medium. As will be seen, however, certain features of the invention are applicable to other scanning-head printing processes as well.

2. Prior Art

U.S. Pat. No. 5,065,169, of Vincent et al., introduces the importance of controlling pen-to-printing-medium distance, and flatness of the medium, in an inkjet printer. The entire disclosure of that patent is hereby incorporated by reference into this document. Vincent discloses one way of performing those functions by means of a spacer formed as a skid, roller or the like that travels with the pen.

That system performs well and is very useful—particularly in the context of a printer that has a single pen. In a multiple-pen printer, however, to facilitate simultaneous printing the pens advantageously are staggered along the direction of printing-medium advance; in such a situation a skid or roller closely associated with each of one or more trailing (downstream) pens would likely smear the ink deposited by one or more leading pens.

Under some circumstances the patented system might possibly serve even for a dual-pen printer if the skid on the trailing pen were spaced adequately behind the pen, as the skid might still be able to control the pen-to-medium distance adequately at a slightly greater distance from the pen. Due to accumulated stagger distance, this solution would be significantly less satisfactory for a four-pen printer such as is typically employed for color-plus-black inkjet printing.

Even in such cases the patented system might conceivably serve if the printing medium were limited to paper, for ink might be absorbed by the paper quickly enough to permit sliding or rolling of the spacer device over a printed area without smearing the deposited ink. In particular such a system might be rendered adequate with evaporative drying enhanced through aids such as a heater or fan, or slow throughput (printed area per unit time) to extend drying time, or combinations of these provisions.

Modern color-plus-black printers, however, are called upon to print transparencies and also to print on other glossy printing media—and to perform these feats at high speed. These plastic printing surfaces are much less absorbent than paper and typically require a heater or fan, as well as special printing modes, just to obtain adequate drying speed and throughput—without regard to stabilizing ink-drop flight distance or flattening the medium.

In fact use of a heater has become commercially important to hasten drying and has in turn introduced still other problems. In a heated print zone, changes in the temperature and humidity of a printing medium cause the medium (especially paper) to deform—both in and out of the plane of the medium. The problem addressed here is that out-of-plane deformation can cause either a decrease in print quality or collision of a leading edge of the medium with part of the mechanism—e.g., a so-called "paper crash" or "paper jam".

Failures of the printing medium to pass smoothly through the apparatus can manifest themselves in tearing or folding of the medium, or in smearing of the printed image. Whatever the form, such failures are very costly in terms of wasted material and time, and also in operator frustration; and therefore strongly affect the acceptability of a printing machine.

Hence other solutions have been sought. FIGS. 4 and 5 illustrate a representative paper-guide or hold-down-plate arrangement that has been employed in one printer available commercially from the Hewlett Packard Company as that firm's Model XL300 PaintJet®.

As can be seen, the arrangement provides a single hold-down plate 121 that extends completely across and beyond the entire width of the largest size of printing medium 130' accepted by the unit—thus covering and controlling not only a relatively small or narrow sheet 130 but also a relatively large or wide sheet 130'. In the system under discussion the downstream or output edge 122 of the hold-down plate 121 is nearly tangent to the top of the drive roller 125, and spaced just slightly above the roller surface.

The plate 121 is upstream (along the direction 133 of paper advance) from a preferably heated print zone 134—which is the operating region of the nozzles 111 of one or more pens 110—or in other words along the input side of that zone 134. (To keep the diagrams simple and therefore clear, only one pen 110 is shown; but ordinarily in such systems three color-ink pens and one black-ink pen are present, and the single pen in the diagrams is to be understood as representative of all four.) A pinch roller 124 in turn is upstream from the plate, but positioned partway down around the drive roller 125, to hold the printing medium 130 in tight contact with the drive roller 125.

The drive roller 125 is about forty-five millimeters in diameter, and the pinch roller 124 about twelve. To avoid smearing ink deposited in the print zone 134, and also to avoid interference with one or more tension rollers 127 and particularly one or more mating star wheels 126, no plate is provided on the downstream—or output—side of the print zone 134.

(FIG. 6 shows what is meant by a "star wheel": the hub 45 and rollers 46 are molded together from a material commercially known as "Acetal®", which is twenty-percent Teflon®; and the sharp traction gears or "stars" are of fully hardened industrial-specification 302 stainless steel. The specific configuration illustrated is not prior art, but rather is a preferred form for use in the present invention.)

The hold-down plate 121 holds the medium 130 or 130' flat, immediately adjacent to the print zone 134; that is to say, the pen or pens 110 print close to the plate 121 but not on it. By holding the medium 130, 130' flat, the plate 121 generally deters paper jams and enhances print quality.

Through extensive observation and experiment, however, it has been found that the plate 121 does not prevent paper jams and optimize print quality consistently. Sometimes the lateral edges 135L, 135R (or 135L', 135R') of the page 130 (130') curl upward; this deformation requires raising the carriage (not shown) and pens 110, to avoid collision—which in turn lowers print quality by causing uncertainty in time of flight (as explained in the Vincent patent) and by causing spray.

Also addressed to the problems of print-medium deformation is another part of the system illustrated in FIGS. 4 and 5. The tension roller or rollers 127 and star wheels 126 disposed at the output or downstream side of the print zone 134.

The tension roller 127 and star wheel 126 are centered a distance 128 of some 4½ centimeters from the drive-roller 125 centerline 125C. They are also about that same distance from the downstream edge 122 of the hold-down plate 121.

The tension roller 127 is typically about nineteen millimeters in diameter, and the star wheel 126 about six. The tension roller 127 and star wheel 126 constrain the medium 130 (or 130') in two ways.

First, the star wheels 126 constrain the medium 130, 130' vertically against the tension roller 127. Secondly, in the region between the two pairs of rollers 124/125, 126/127 the tension roller 127 and star wheel 126 hold the medium 130 taut and therefore relatively flat.

To accentuate this second effect, the tension roller can be overdriven. This means that the tension roller 127 and thereby the star wheel 126 are driven at a slightly greater rate than the drive roller 125, but with a clutch arrangement or the like to allow for slippage.

This part of the system too, unfortunately, is not always entirely adequate in constraining the medium enough to prevent a jam. In fact through observation and experiment it has been found that the leading edge 131 or 131' of the medium sometimes strikes one or the other star wheel 126 too high.

More specifically, the medium sometimes strikes a star wheel 126 above the point on the wheel at which that wheel can capture the edge 131, 131' and channel it properly downward against the tension roller 127. The result is a paper crash or jam—spoiling the sheet 130, 130' of printing medium, interfering with operation, and usually requiring operator intervention to clear the mechanism and reinitiate proper passage of a fresh sheet through the printer.

Printing machines of the type under discussion are also subject to a related problem. When the trailing edge 132 of the printing medium passes the pinch roller 124, the medium is no longer taut and is driven solely by the downstream tension roller 127 and star wheel 126.

With careful mechanical design, the effects of the absence of tautness as such can be rendered unimportant; but curiously the fact that the tension roller 127 has become the only driver has a significant adverse consequence. If the tension roller 127 is relatively small in diameter—as compared for example with the drive roller 125—then the relative accuracy of the printing-medium advance by the tension roller is necessarily poor.

In operation of this type of printing machine, periodically the printing-medium advance mechanism 124–127 is actuated to advance the medium stepwise—by some normal distance 41 (FIG. 7) at each step. This typically occurs between repetitions of scanning the print head 110 across the printing medium 130.

Accordingly, on the one hand, with a small tension roller, the amount of printing-medium advance cannot be controlled accurately in the end-of-page region after the drive roller can no longer engage the sheet. A result is significant mutual misalignment of successive printed swaths resulting from successive print-head scans.

The mutually misaligned swath borders appear conspicuously, making each swath stand out visually as a separate printed strip or band rather than blending smoothly into a single image. This undesirable effect accordingly is called "banding".

Banding is noticeable in large part because the positioning error accumulates or accrues over a significant distance of paper advance. That distance (in a three-pass system with a pen having ninety-six nozzles, and approximately twelve nozzles per millimeter) is the height 41 of one-third of a swath, or typically thirty-two pixel rows—equalling roughly 2½ millimeters (one-tenth inch).

If, on the other hand, the tension roller is instead made relatively large in diameter, then the starwheel/tension-roller contact area is forced further from the print zone, diminishing control over the printing medium in that zone. What is desired is both accurate advance and good control of the medium.

The end-of-page region under consideration here has a height 140 (FIG. 7) corresponding approximately to the distance 128 (FIGS. 4 and 5)—measured along the printing-medium 130 path—between the contact areas of the two roller pairs 124/125, 126/127. As can be seen from FIG. 5, this distance substantially equals the direct center-to-center distance 128 between the drive and tension rollers 125, 127, plus roughly a quarter the circumference of the drive roller 125.

The total, based on dimensions recited earlier, is roughly nine centimeters (3½ inches). Accordingly, in the prior-art system illustrated, the banding effect is not only significant in magnitude and therefore quite noticeable, but also extended over a distance 140 (FIG. 7) which is a rather large fraction of the height of each sheet.

Some leading-edge and trailing-edge problems of printing-medium control are sometimes addressed by inhibiting printout near the leading and trailing (top and bottom) edges of each sheet. The necessity for heating the medium in those areas is thereby obviated, reducing curl etc.

This technique can reduce the likelihood of unrestrained corners being in the print zone and so minimize the likelihood of crashes. Unfortunately, however, as will be appreciated this technique produces unacceptably large top and bottom margins.

In summary, prior systems are sometimes subject to paper crashes particularly near the leading edge of each sheet, degraded image quality due to curling and other flight-time-related errors particularly along the lateral edges over the full height of each sheet, and banding near the trailing edge. As can now be seen, important aspects of the technology which is used in the field of the invention are amenable to useful refinement.

As the present invention applies printmode techniques in regard to certain of the problems discussed above, we discuss below some related printmode art. Considerable detail is presented. The principal point, however, will be simply to demonstrate that for programming in any sort of pixel-based printing it is fundamental to be able to determine or keep track of the point in the image data to which the printing process has progressed and to control the printing process in response to that determination.

To achieve vivid colors in inkjet printing with aqueous inks, and to substantially fill the white space between addressable pixel locations, ample quantities of ink must be deposited. Doing so, however, requires subsequent removal of the water base—by evaporation (and, for some printing media, absorption)—and this drying step can be unduly time consuming.

In addition, if a large amount of ink is put down all at substantially the same time, within each section of an image, related adverse bulk-colorant effects arise: so-called "bleed" of one color into another (particularly noticeable at color boundaries that should be sharp), "blocking" or offset of colorant in one printed image onto the back of an adjacent sheet with consequent sticking of the two sheets together (or of one sheet to pieces of the apparatus or to slipcovers used to protect the imaged sheet), and "cockle" or puckering of the printing medium. Various techniques are known for use together to moderate these adverse drying-time effects and bulk- or gross-colorant effects.

(a) Prior heat-application techniques—Among these techniques is heating the inked medium to accelerate evaporation of the water base or carrier. Heating, however, has limitations of its own; and in turn creates other difficulties due to heat-induced deformation of the printing medium.

Glossy stock warps severely in response to heat, and transparencies too can tolerate somewhat less heating than ordinary paper. Accordingly, heating has provided only limited improvement of drying characteristics for these plastic media.

As to paper, the application of heat and ink causes dimensional changes that affect the quality of the image or graphic. Specifically, it has been found preferable to precondition the paper by application of heat before contact of the ink; if preheating is not provided, so-called "end-of-page handoff" quality defects occur—this defect takes the form of a straight image-discontinuity band formed across the bottom of each page when the page bottom is released.

Preheating, however, causes loss of moisture content and resultant shrinking of the paper fibers. To maintain the paper dimensions under these circumstances the paper is held in tension by a system of pinchwheels used in conjunction with paper-advance drivewheels.

Unfortunately these provisions have their maximum effect, in preventing image-quality defects, only while the paper is constrained by the wheels. As soon as the bottom of the page has been printed and the paper leaves the constraint of the wheels, the paper contracts.

This happens very quickly, and as it does the paper and the dots of ink on it move in at the edges and up in the center. The quality defect caused by this sudden releasing of stress can be identified as an "end-of-page paper-shrink defect"; it appears as a thin arched gap of reduced color density.

Prior efforts to eliminate this arched gap have included avoiding the page-long accumulation of stress by cyclically lifting or releasing the constraining force of the pinchwheels. This works to decrease the paper-shrink defect by allowing the internal stress to be released or equalized incrementally—rather than cumulatively.

Unfortunately, however, this cyclical-release technique sacrifices control over paper position at each of the release points along the way. This loss of paper-position control can create numerous misalignment regions that are a greater problem than the paper-shrink defect.

(b) Prior print-mode techniques—Another useful technique is laying down in each pass of the pen only a fraction of the total ink required in each section of the image—so that any areas left white in each pass are filled in by one or more later passes. This tends to control bleed, blocking and cockle by reducing the amount of liquid that is all on the page at any given time, and also may facilitate shortening of drying time.

The specific partial-inking pattern employed in each pass, and the way in which these different patterns add up to a single fully inked image, is known as a "print mode". Heretofore three-pass print modes have been used successfully to reduce bulk-colorant problems on paper—but less successfully on glossy and transparency stock, which are much less absorbent and so rely to a greater extent upon evaporation.

Attempts have also been made to use print modes for hiding the paper-shrink error discussed in subsection (a) above. Heretofore such efforts have had relatively little effectiveness, or have caused still other problems.

For example, some print modes such as square or rectangular checkerboard-like patterns tend to create objectionable moire effects when frequencies, harmonics etc. generated within the patterns are close to the frequencies or harmonics of interacting subsystems. Such interfering frequencies may arise in dithering subsystems sometimes used to help control the paper advance or the pen speed.

Checkerboard print-mode patterns also are subject to objectionable so-called "banding"—horizontal stripes across the finished image. These arise because between each swath the paper advances by substantially the full height of a swath, in effect another type of cumulative-error display.

Print-mode patterns that are instead made up of either mostly all horizontal or mostly all vertical elements can still produce similar interference effects, but only along that direction of the pattern (the direction along which most of the pattern elements are aligned)—and also tend to exaggerate other print-quality defects in the directional lateral to the pattern. Such problems have defeated earlier efforts to find print-mode solutions to the end-of-page paper-shrink problem.

(c) Known technology of print modes: general introduction—One particularly simple way to divide up a desired amount of ink into more than one pen pass is the checkerboard pattern mentioned above: every other pixel location is printed on one pass, and then the blanks are filled in on the next pass.

To avoid the banding problem (and sometimes minimize the moire patterns) discussed above, a print mode may be constructed so that the paper advances between each initial-swath scan of the pen and the corresponding fill-swath scan or scans. In fact this can be done in such a way that each pen scan functions in part as an initial-swath scan (for one portion of the printing medium) and in part as a fill-swath scan.

Once again this technique tends to distribute rather than accumulate print-mechanism error that is impossible or expensive to reduce. The result is to minimize the conspicuousness of—or, in simpler terms, to hide—the error at minimal cost.

For instance a two-pass print mode may start a page by printing with only some of the nozzles in an array of only half of the pen's nozzles, all positioned at one end of the pen—as an example, selected ones of the nozzles consecutively numbered one through fifty, on a hundred-nozzle pen. This first pass may be in a checkerboard pattern—thus actually using, e.g., for example, exclusively odd-numbered nozzles 1, 3, . . . in the first row, and then only even-numbered nozzles 12, 14, . . . in the second row, next selecting only odd-numbered nozzles 21, 23, . . . again in the third row, etc.—and thus printing in half of the pixel locations in the swath area.

The paper then advances by a distance equal to the length of the half-array of nozzles (in other words, the height of fifty nozzles), and the pen would print in both ends of its nozzle array—but again only printing a fifty-percent checkerboard pattern. Now, however, while the forward end of the pen (selected ones of nozzles one through fifty) as before prints on fresh paper, the rearward end (selected ones of nozzles numbered fifty-one through one hundred) fills in the area already printed.

This behavior is then repeated all down the page until the last swath—which is a fill-in swath only, again using selected nozzles of those numbered fifty-one through one hundred.

(d) Space- and sweep-rotated print-mode masks—The pattern used in printing each nozzle section is known as the "print-mode mask". The term "print mode" is more general, usually encompassing a description of a mask, the number of passes required to reach full density and the number of drops per pixel defining "full density".

In the two-pass example above, the second half of the pen (certain ones of nozzles numbered fifty-one through one hundred) filled in the blank spaces left by the first half. For each pass, this may be symbolized using a letter "x" for each pixel that is printed and a letter "o" for each pixel that is not, as follows.

| pattern 1:<br>nozzles 1 through 50 | pattern 2:<br>nozzles 51 through 100 |
|---|---|
| xoxoxoxoxo | oxoxoxoxox |
| oxoxoxoxox | xoxoxoxoxo |
| xoxoxoxoxo | oxoxoxoxox |
| oxoxoxoxox | xoxoxoxoxo |
| xoxoxoxoxo | oxoxoxoxox |

In each of these diagrams, the xs appear in diagonal lines—which are angled, if the vertical and horizontal spacings are the same, at forty-five degrees (to both the columns and rows). These lines of xs represent pixels that are printed (if the desired image calls for anything to be printed in each of those pixels respectively), and the os represent diagonal lines of pixels that are not printed.

To conserve space in this document, the diagrams above represent only eight pixel rows, out of fifty created by each half of the hundred-nozzle pen that is under discussion. The nozzles are laid out along the pen in substantially only one vertical row, one hundred nozzles long—although as a practical mechanical matter they are staggered laterally to permit very close spacing along the vertical axis. Therefore to obtain the checkerboard (or other) patterns described in this document the various nozzles are fired selectively and rapidly many times, in careful synchronism with scanning of the pen across the printing medium—taking into account not only the scanning motion across the page but also the nozzle staggering across the pen.

In the "pattern 1" diagram, one line of xs begins in the upper left-hand corner, and at pixel positions offset by two pixels along both top and left-hand edges of the pattern. In the "pattern 2" diagram, however, it is instead a line of os that begins in the corner, whereas lines of xs begin at positions offset from the corner by just one pixel along the top and left-hand edges—and so fitting between the lines of xs put down by "pattern 1".

Hence these diagrams show that pixel positions left unprinted by the first ("pattern 1") pass are filled in by the second. In other words, looking all the way across any row—and taking into account all the xs formed by both "pattern 1" and "pattern 2" in the aggregate—all positions in the row are filled.

One way to achieve this pattern is to always keep nozzles one through fifty in "pattern 1", and always keep nozzles fifty-one through one hundred in "pattern 2". This is known as "space rotated" masking; using this method to print down the page would progressively produce these patterns—illustrated here too using an abbreviated vertical nozzle-array representation of just eight nozzles rather than one hundred:

| pass 1 | pass 2 | pass 3 | pass 4 | pass 5 |
|---|---|---|---|---|
| - - - -<br>\|  \|<br>\|  \|<br>\|  \| | | | | |
| xoxo | oxox | | <- first printed row | |
| oxox | xoxo | | | |
| xoxo | oxox | | | |
| oxox | xoxo | | | |
| | xoxo | oxox | <- fifth printed row | |
| | oxox | xoxo | | |
| | xoxo | oxox | | |
| | oxox | xoxo | | |
| | | xoxo | oxox | |
| | | oxox | xoxo | |
| | | xoxo | oxox | |
| | | oxox | xoxo | |
| | | | xoxo | oxox |
| | | | oxox | xoxo |
| | | | xoxo | oxox |
| | | | oxox | xoxo |
| | | | | \|  \| |
| | | | | \|  \| |
| | | | | \|  \| |
| | | | | - - - - |

In this mode, the pen uses the same pattern all down the page, but the mask is different in different portions of the pen: "pattern 1" for nozzles one through fifty (represented in the abbreviated drawing by the lower four positions in each eight-nozzle group); vs. "pattern 2" for nozzles number fifty-one through one hundred (represented by the upper four positions in each group).

The availability of this method of masking for various printing devices depends in part on the basic mechanical and firmware architecture of each device. In particular, it depends upon whether the basic operating system provides for efficient addressing of different mask patterns to different segments of the overall nozzle array.

Another way to use the same print mode is to apply one mask pattern to the entire pen, but to change that mask pattern from pass to pass. This is so-called "sweep rotated" masking—still using the same abbreviated representation for purposes of illustration:

```
pass 1   pass 2   pass 3   pass 4   pass 5
----
|  |
|  |
|  |
xoxo     oxox               <- first printed row
oxox     xoxo
xoxo     oxox
oxox     xoxo
         oxox     xoxo      <- fifth printed row
         xoxo     oxox
         oxox     xoxo
         xoxo     oxox
                  xoxo      oxox
                  oxox      xoxo
                  xoxo      oxox
                  oxox      xoxo
                            oxox      xoxo
                            xoxo      oxox
                            oxox      xoxo
                            xoxo      oxox
                                      |  |
                                      |  |
                                      |  |
                                      ----
```

In both these diagrams—as in the basic "pattern 1" and "pattern 2" diagrams discussed just before, it can be seen by reading all the way across any row that after both passes at each row all positions in that row are filled—but by comparing the space- and sweep-rotation diagrams it will now be appreciated that the order in which some of the positions are filled in sweep rotation is opposite to that in which they are filled in space rotation. For example, in the fifth printed row the left-hand column is printed in the second pass (and the adjacent column left blank for printing later) in space rotation—but is printed in the third pass (after the adjacent column) in sweep rotation.

This can be shown more compactly by a different notation that allows comparison of space and sweep rotation side by side. In this notation, "0" represents nozzle groups that are not fired at all—at the top and bottom scans of the page—while "1" and "2" represent not individual pixel rows but rather half-swaths, in "pattern 1" and "pattern 2" as defined above.

| Space rotation | Sweep rotation |
|---|---|
| 0 | 0 |
| 1 2 | 1 2 |
| 1 2 | 2 1 |
| 1 2 | 1 2 |
| 1 2 | 2 1 |
| 1 2 | 1 2 |
| 0 | 0 |

Now in these abbreviated forms it is easier to see that within the printed image every half-swath receives one "1" and one "2"—but not always in the same order. Thus in the second half-swath the "1" goes down first in space rotation, but second in sweep rotation.

(e) Autorotatina print-mode masks—Operating parameters can be selected in such a way that, in effect, rotation occurs even though the pen pattern is consistent over the whole pen array and is never changed between passes. Figuratively speaking this can be regarded as "automatic" rotation or simply "autorotation".

To understand what produces this condition, it is necessary first to take note of what constitutes a basic cell or unit of the print-mode mask, and then to note its height $h_c$ in pixels. It is also necessary to note the number of pixels (or the length measured in number of nozzles) by which the paper moves $m_p$ in each of its advances. For example, in the simple cases diagrammed above, since each mask repeats every two rows, $h_c$=2; and the paper advances by fifty nozzles at a time, so $m_p$=50 (or as in the abbreviated-notation diagram the paper advances four diagrammed nozzles at a time, so $m_p$=4).

The next step is to determine whether the ratio $m_p/h_c$ of these two parameters is integral. If so, as in this case, since $m_p/h_c$=50/2=25 actually (or 4/2=2 as illustrated), the mask will not autorotate.

If however, in the two-pass example the paper advances by three diagrammed pixel rows instead of four—but the basic cell remains two pixels tall—then for this case as diagrammed the ratio $m_p/h_c$=3/2 is nonintegral and at each pass the mask will "automatically" fill in the blank spaces left by the previous pass:

```
pass 1   pass 2   pass 3   pass 4   pass 5
xoxo
oxox
xoxo
oxox     xoxo
xoxo     oxox
oxox     xoxo
         oxox     xoxo
         xoxo     oxox
         oxox     xoxo
                  oxox     xoxo
                  xoxo     oxox      . . .
                  oxox     xoxo
                           oxox
                           xoxo
                           oxox
```

(This diagrammatic example symbolizes a real case of, for instance, three passes, a total of ninety-six nozzles used in the pen, thirty-two nozzles used in each of three sections of the pen, thirty-two-nozzle printing-medium advance—and a basic-pattern cell three pixels tall. In algebraic notation, $m_p/h_c$=32/3, a nonintegral ratio. This three-pass mode is discussed in the next section.)

The print mode produced in this way is essentially a space-rotation mode (though in a sense that condition is not specifically called for). For example, if the pen is a six-row pen as diagrammed above, the first three rows are in "pattern 1" and the second three are in "pattern 2":

```
xoxo
oxox          pattern 1
xoxo
-------------
oxox
xoxo          pattern 2
oxox
```

For an autorotating case, either "pattern 1" or "pattern 2" may be used all down the pen. Thus the paper advance turns one simple pattern into a space-rotated mask "automatically". In the shorthand notation introduced above, the pen provides the following periodic behavior as the paper advances.

| autorotation |
|---|
| 0 |
| 1 2 |
| 1 2 |
| 1 2 |
| 1 2 |
| 0 |

(f) Three-pass modes—Heretofore, one highly favored print mode has specified a one-third-density-per-pass pattern that constructs dots in a diagonal pattern— xoo oxo oox

—rather than the one-half-density-per pass checkerboard modes discussed above. The diagonals, however, remain at forty-five degrees as in the checkerboard mode.

This pattern has been considered advantageous because it worked well with software dithering algorithms and had minimal tendency to create moire patterns when printing partial-density-shaded and gradient area fills. The use of forty-five-degree diagonals was considered particularly beneficial for its tendency to distribute error-hiding capability equally between vertical and horizontal axes of the pixel array to be constructed on the printing medium.

Generally a printing apparatus is characterized—through its basic hardware and firmware design architecture—by a general maximum-size print mask or mode pattern that can be formed with the apparatus in one pen pass; any mask pattern to be used with a printing apparatus must fit within its maximum pattern. For example, in a particular one printing device (of the Hewlett Packard Company) which produces high-quality images, that maximum mask or pattern size is eight rows tall and four columns wide—and will readily accommodate, among other possibilities, a mask that is three rows tall ($h_c$=3) and three columns wide.

Just such a mask produces the one-third-density diagonal three-pass pattern introduced at the beginning of this section. If that mask is used in conjunction with a unit paper advance of thirty-two nozzles—for a printing-medium advance movement $m_p$=32—then the previously introduced ratio $m_p/h_c$=32/3, which is not integral.

This combination of conditions accordingly provides autorotation of the three-row mask pattern shown above (as noted parenthetically in the preceding section). No mask rotation sequence is required; and a mask specification for the three passes accordingly might read "111" to indicate that the first column of the pattern should be used in common to begin each sweep—that is, printing the pixel in column number one of the top row of the swath (assuming that there is any image information to print there). Equally well a mask specification might read "222" or "000", as indeed the pattern may begin with printing in any of the three columns of the basic cell.

If instead the number of dot rows were an integral multiple of the pattern height, then as previously explained the printer would have to be instructed to use a rotation sequence telling it how to build the pattern in each succession of sweeps. For example, using the same three-row pattern but thirty-three-nozzle advance—which is to say, a printing-medium-advance movement of thirty-three dot rows—the ratio $m_p/h_c$=33/3 is integral, and a rotation sequence must be specified.

Such a sequence might be "012". The numbers are the swath or pass numbers in which the respective columns of the base pattern will start a page. The printer will form so-called "swath number zero" (the first swath) using the first column of the pattern as the first column at top of the page, swath one (the second swath) using the second column as the first column at top of the page, and swath two (the third swath) using the third column, as follows.

| pass 1 | pass 2 | pass 3 | |
|---|---|---|---|
| xoo | oox | oxo | |
| oxo | xoo | oox | |
| oox | oxo | xoo | |
| 0 | 1 | 2 | <- starting column |

The other equally acceptable sequences would be "021", "102", and all the other six rotations ("120", "201"; etc.) of these three root sequences. Now if a printer is stopped halfway through a page, using this cell and a diagrammatic six-dot-row paper advance, a pattern something like the following will be found—regardless of whether space or sweep rotation is in use.

| | |
|---|---|
| xxxxxxxxxxxxxx<br>xxxxxxxxxxxxxx<br>xxxxxxxxxxxxxx<br>xxxxxxxxxxxxxx<br>xxxxxxxxxxxxxx<br>xxxxxxxxxxxxxx | completely filled |
| xxoxxoxxoxxoxx<br>oxxoxxoxxoxxox<br>xoxxoxxoxxoxxo<br>xxoxxoxxoxxoxx<br>oxxoxxoxxoxxox<br>xoxxoxxoxxoxxo | two-thirds filled |
| oxooxooxooxoox<br>ooxooxooxooxoo<br>xooxooxooxooxo<br>oxooxooxooxoox<br>ooxooxooxooxoo<br>xooxooxooxooxo | one-third filled |

As before, this abbreviated diagram symbolizes the modernly more interesting practical case of thirty-three-nozzle advance. That case if fully pictured would appear as thirty-three rows fully filled, another thirty-three two-thirds filled, and thirty-three more one-third filled.

(g) Print-quality defects on transparency and glossy stock—As mentioned earlier, known techniques have not been entirely successful in eliminating bulk-colorant problems on transparent and other glossy media. Dividing the total desired amount of ink into three passes has been considered the limit for application of print-mode techniques in attempts to solve this problem.

As noted earlier, evaporation from these media—because they are relatively much less absorbent—is necessarily more important that from plain paper. Some evaporation can be obtained straightforwardly by convection (stimulated by an air-circulating fan), but inducing evaporation by applying radiative heat takes on greater importance with plastic media.

Heat, however, is most straightforwardly applied from below (the opposite direction from that of ink application). These media present more thermal mass and therefore an effectively longer thermal path than does plain paper.

Accordingly with these media a much greater fraction of applied heat radiation ends up absorbed in the printing medium as compared with the ink carrier; this adverse energy distribution is compounded by the previously mentioned dimensional hypersensitivity of these media to heat. Generally speaking, as can be seen from the foregoing discussion, the application of heat is more problematic for glossy and transparent stock than for plain paper.

Heretofore the lower liquid absorption, higher heat absorption, and higher dimensional sensitivity to heating, of these media has defied efforts to obtain adequate liquid removal. Accordingly the prior art has left considerable room for refinement in this area.

(h) Black-ink detail—Printing-machine users often prefer to present lettering and certain other types of finely detailed image elements in black, and the eye is capable of discerning black-inked elements (and defects in them) quite sensitively—as compared with elements and defects marked in other colors. It would therefore be desirable to use finer position control for black inking than for other colors, even within the same image.

Such a strategy, however, is difficult to implement. Generally speaking, the fineness of position control, or to put it another way the pitch of the pixel array, is commonly set by the frequency of a waveform derived by electrooptically reading, while the pen scans, a special scale extended across the printing medium.

Within a printing machine of reasonable cost it is preferable to employ multiplexing techniques for control of the pens. In other words, a single set of signal lines—and control signals time-sharing or otherwise coexisting in those lines—is used to operate all of the pens.

Providing finer position control for printing of black in direct conjunction with other colors would require somehow establishing a separate such waveform for black. That waveform would have to be provided simultaneously with the position-establishing waveform for the other colors—but at a different, higher frequency.

It would also require arranging for the signals of different frequencies to share the same basic positionsignal transmitting system. These special provisions, to accommodate established multiplexing arrangements, would be awkward or at least costly. In engineering jargon, electrically it would be hard to "talk" to a color pen (for instance, a cyan pen) and a black pen at the same time.

An alternative would be to print black in a separate sweep, between sweeps for the chromatic-color pens. This alternative would pay a heavy price in reduced throughput and accordingly would be very undesirable.

SUMMARY OF THE DISCLOSURE

The present invention introduces refinements as called for above. The invention has different facets or aspects, which can be practiced independently—but which, to optimize and enhance the benefits of the invention, are preferably used in combination together.

In preferred embodiments of a first of these aspects, the present invention is apparatus for printing images by marking with a liquid-base ink on a web-form printing medium that has a longitudinal direction and two lateral edges. The apparatus includes some means for supporting such a medium; for purposes of breadth and generality in expressing the invention, these means will be called the "supporting means".

In this discussion and in certain of the appended claims the term "such" is used in reference to the printing medium to indicate that the medium is not necessarily an element of the invention. Rather for some purposes the medium may be regarded as a part of the operating environment, or context, of the invention.

Preferred embodiments of the first aspect of the invention also include a marking head disposed for marking on such medium—and also some means for engaging such medium and for advancing such medium longitudinally past the marking head. These latter means, again for generality and breadth, will be called the "engaging-and-advancing means".

Also included are first guide means for restraining such medium. The first guide means perform such restraint over an area that is:

upstream, longitudinally, from the marking head, and extended laterally across substantially a full width of such medium except in one or more regions that are laterally near the engagement of the engaging-and-advancing means with such medium.

(The phrase "that are laterally near" is used herein to convey that certain elements are relatively close together when taking into account only components of distance in the lateral direction—that is to say, the direction transverse to the direction of printing-medium advance. Thus those elements may be relatively far apart along the direction of printing-medium advance, but may still satisfy the condition that they are laterally near.)

Preferred embodiments of the invention, still with respect to its first facet, also include second guide means for restraining such medium, over an area that is:

disposed laterally from the marking head, and extended laterally across such medium only in one or more regions that are laterally near the engagement of the engaging-and-advancing means with such medium.

The apparatus further includes some means, longitudinally beyond the marking head from the advancing-and-engaging means and generally aligned laterally with the advancing-and-engaging means, for tensioning such medium away from the advancing-and-engaging means to hold such medium substantially taut at the marking head. In this case such printing medium, when tensioned between the advancing-and-engaging means and the tensioning means, moves stepwise through the apparatus at a normal distance of advance in each step.

The apparatus further includes means for sensing when a longitudinally rearward edge of such printing medium passes the advancing-and-engaging means so that such printing medium is advanced only by the tensioning means. The apparatus also includes some means, responsive to the sensing means, for decreasing the distance of advance through the apparatus in each step while such printing medium is advanced only by the tensioning means.

The foregoing may constitute a definition or description of the first facet or aspect of the invention in its broadest or most general form. It can be seen, however, that even in this form this first aspect of the invention resolves problems with which the prior art did not deal optimally.

In particular, because the first guide means do not interfere with the engaging-and-advancing means, the engaging-and-advancing means can be placed immediately upstream of the print zone, rather than being necessarily offset from it along the advance path by 3½ centimeters (1½ inches) or more as are the drive roller and pinch wheel of the prior system discussed above. This alone very advantageously decreases the height of the end-of-page zone; and as will be seen other dimensional refinements are possible to decrease that height still further.

In addition, because the second guide means are generally in the same region, laterally, as the engaging-and-advancing means—and most typically therefore in the same region laterally as a tensioning system, which is advantageously included—the second guide means very effectively prevent the medium from curling upward to strike tensioning-system components (as for example the medium strikes the pen or star wheels in the above-discussed prior system)—or the pen.

The sensing means and decreasing means cooperate to minimize image determination when a trailing edge of the print medium cannot be held taut.

Although the invention thus provides very significant advances relative to the prior art, nevertheless for greatest enjoyment of the benefits of the invention it is preferably practiced in conjunction with certain other features or characteristics which enhance its benefits.

For example, it is preferred that the engaging-and-advancing means in fact engage such medium only near the lateral edges of such medium; and that the first guide means restrain such medium over an area that is extended laterally across substantially a full width of such printing medium except near the lateral edges of such medium. More specifically, it is even more highly preferable that the first guide means restrain such medium over an area that is extended laterally across the width of such printing medium except for a strip, about one and a half centimeter wide, along each lateral edge.

Again as the first guide means do not extend fully to the lateral edges of the printing medium, if the drive roller and pinch wheel are positioned near those edges they can be longitudinally very near the print zone. Despite this proximity they can also be kept near the lateral edges of the medium where any surface disturbance which they may produce (e. g., impressions from a pinch wheel) can be clear of the image area.

Furthermore, placement of the second guide means along the lateral edges of the medium, just outside the print zone to left and right, very effectively prevents those edges from curling upward to erratically vary the ink-drop flight distance—as well as to strike tensioning-system components or the pen, per the more general case already discussed. This improved control thus significantly improves image quality as well as the reliability of printing-medium advance.

It is further preferable that the second guide means be bifurcated, disposed laterally in two directions from the marking head, and extended laterally across only the lateral edges of such medium—to hold such medium at its lateral edges. Again more specifically, the second guide means preferably are extended laterally across a strip, a few millimeters wide, along each lateral edge. Ideally the strip along each lateral edge, respectively, is approximately three millimeters wide.

Preferably the apparatus also includes a human-actuable control for selecting a printing-medium width from a plurality of widths accommodated by the apparatus; and some means responsive to the control for laterally shifting at least one of the bifurcations of the second guide means. This feature is particularly desirable in a bifurcated-second-guide-means system, with the second guide means disposed along the edges of the printing medium—to retain the ability of earlier systems to handle printing-medium sheets of more than one width.

Preferably too the marking head operates in a print zone; the advancing-and-engaging means are very closely spaced upstream from the print zone; and the tensioning means are very closely spaced downstream from the print zone. As will be seen this characteristic can be promoted by advantageous design and dimensioning of the advancing-and-engaging means and the tensioning means.

In preferred embodiments of another of its facets, the invention is a method of printing desired images on a printing medium by construction from individual marks formed in pixel arrays by a scanning print head that operates in conjunction with a printing-medium advance mechanism. This method includes repetitively scanning the print head across the printing medium. It also includes periodically, between repetitions of scanning the print head across the printing medium, advancing the printing medium stepwise, by a normal distance at each step.

The method further includes—generally during the above-mentioned scanning and operating—tensioning such medium between an advance wheel and a tensioning wheel; and determining when a trailing edge of such printing medium passes a first of the advance and tensioning wheels so that such printing medium is no longer tensioned.

The method also includes responding to the determining step by decreasing the distance of advance through the apparatus, at each step, while such printing medium is no longer tensioned.

The foregoing may be a description or definition of the present invention in its broadest or most general terms. Even in such general or broad forms, however, as can now be seen the invention resolves the previously outlined problems of the prior art.

In particular the use of a smaller advance distance in the end-of-page region decreases the undesirable accumulation of positioning error at each step of the mechanism. This decrease correspondingly diminishes the inaccuracy that is available, at each step, to contribute to the objectionable banding described earlier.

Although the second facet of the invention thus provides very significant advances relative to the prior art, nevertheless for greatest enjoyment of the benefits of the invention it is preferably practiced in conjunction with certain other features or characteristics.

For example, as previously mentioned it is preferred that the second facet of the invention be practiced in combination together with the first. It is also preferred that the aforementioned "decreasing" include reducing the distance of advance, in each step, to about half the normal distance.

More specifically, it is preferred that the normal distance of advance be approximately thirty-two pixel rows at each step; and that the "decreasing" include reducing the distance of advance to approximately sixteen pixel rows.

In preferred embodiments of a third main aspect, the invention is apparatus closely related to the second facet of the invention.

All of the foregoing operational principles and advantages of the present invention will be more fully appreciated upon consideration of the following detailed description, with reference to the appended drawings, of which:

BRIEF DESCRIPTION OF THE DRAWINGS

FIG. 1 is a generally diagrammatic side elevation of a preferred embodiment of the invention and particularly its above-introduced first facet or aspect;

FIG. 2 is a generally diagrammatic plan view of the FIG. 1 embodiment;

FIG. 4 is an elevation analogous to FIG. 1—but representing the prior-art system discussed earlier in this document;

FIG. 5 is a plan view analogous to FIG. 2, but representing the FIG. 4 prior-art system;

DETAILED DESCRIPTION OF THE PREFERRED EMBODIMENTS

1. Hold-down Plates

Figure 3:
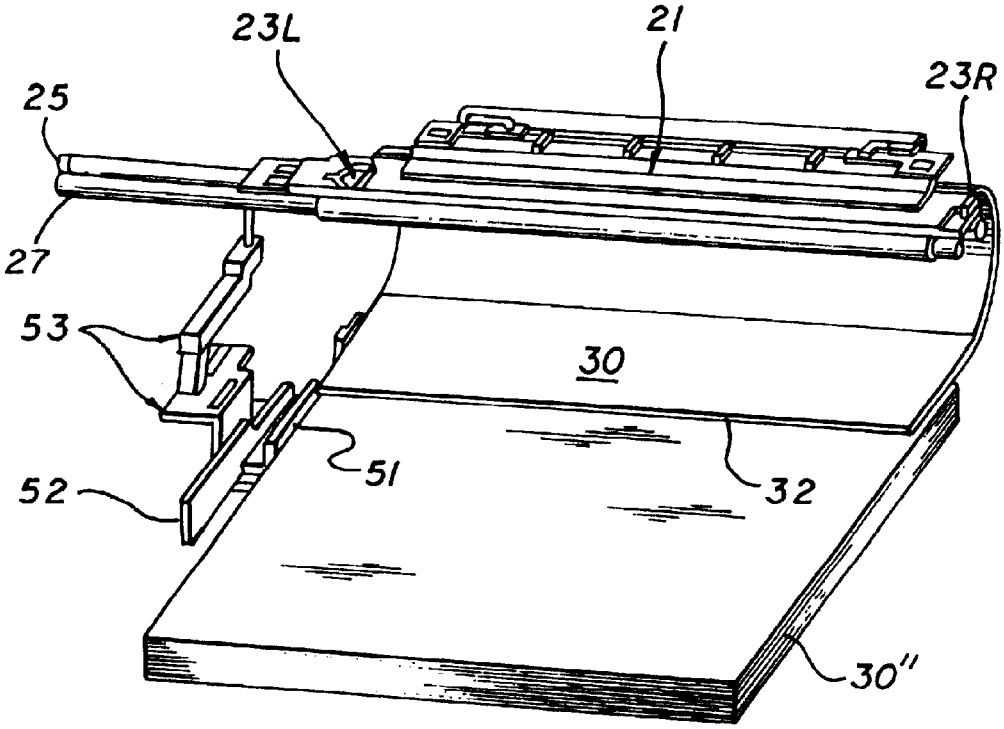
FIG. 3 is a more mechanically pictorial perspective view of the same embodiment.
Figure 6:
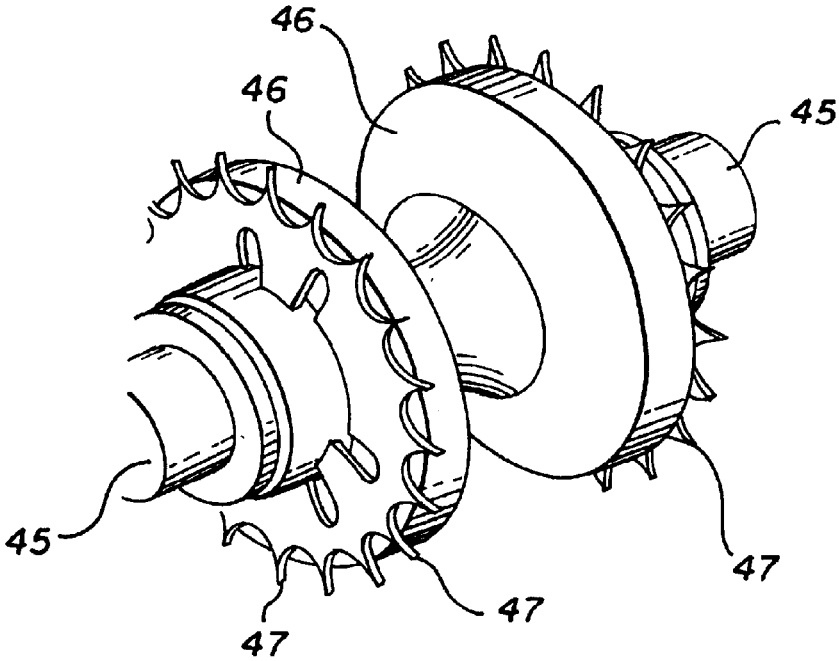
FIG. 6 is a perspective view of a so-called "star wheel" that is, as mentioned earlier, preferred for use in the present invention.

FIGS. 1 and 2 show that in preferred embodiments of the invention the guide means take the form of three discrete plates 21, 23L, 23R for controlling out-of-plane deformation of a printing medium 30, such as paper, as the medium passes in one direction 33 longitudinally through the mechanism. In principle the three elements 21, 23L, 23R might perhaps be consolidated into one or two shaped plates.

One of the three, a generally central plate 21, is positioned with its forward edge 22 just short of the input or upstream edge of the print zone 34—which is to say, the operating zone of the nozzles 11 of a pen 10. The lateral edges 29 of the central plate 21 are spaced inboard, by a distance 36 (preferably 1½ cm), from the left and right edges 35R, 35L of the narrowest medium 30 to be accommodated in the machine.

To both sides of the central plate 21, operating on vertically common centerlines 24C, 25C, are drive wheels 25 and pinch rollers 24. At one side (for instance the left side) these may be, as preferred, either extended or shiftable laterally to accommodate wider print-media stock.

The other two plates are respectively left- and right-side guides 23L, 23R, disposed laterally to left and right, respectively, from the print zone 34. The inboard edge of each side guide 23L, 23R is spaced inboard, by a distance 37 (preferably 3 mm), from the lateral edges 35L, 35R of the medium respectively.

Preferably at least one 23L of these side guides is shiftable laterally—as, for instance, to a further-outboard position 23L', similarly disposed with a 3 mm overlap relative to the left edge 35L' of wider print-media stock—to accommodate such wider stock. The shifting may be controlled automatically, as in response to the width of print media loaded into the machine, or as FIG. 3 shows may be operator actuated in accordance with a selected print-medium width.

The plates 21, 23L, 23R hold the printing medium 30 against a preferably heated flat backup or support surface 20 (although certain of the other elements also function to support the medium 30). This consistent flat orientation helps to provide good print quality.

2. Problem Areas

Tensioning rollers 27 and star wheels 26 are positioned on vertically common centers 26C, 27C just past the output or downstream edge of the print zone 34. These elements pull the print medium 30 taut relative to the drive rollers 24 and pinch wheels 25, as long as the trailing edge 32 of the medium 30 has not yet passed through those rollers and wheels 24, 25.

After the trailing edge 32 of the medium 30 has passed those elements 24, 25, the tensioning rollers 27 and star wheels 26 continue to pull the medium 30 through the print zone 34, to complete printout of the desired image on the sheet 30. The centerlines of the two sets of rollers 26C/27C, 24C/25C are separated by a distance 28 (preferably three centimeters, roughly 1.2 inch) that is less than four times the longitudinal dimension 34' (most typically about eight millimeters, about 0.32 inch) of a single-pen print zone 34.

Although for simplicity of the drawings just one pen 10 is shown explicitly, we mean it to represent the four pens in a typical color-plus-black inkjet printer. Hence it will be understood that the above-mentioned distance 28—as contrasted with the analogous distance 128 in the prior-art system discussed earlier—very closely encompasses the full print-zone dimension for all four pens. The distance 28 is just great enough to allow all the pens to scan back and forth across the sheet and print, without mutual interference of their respective printed swaths—and without striking the pinch or star wheels.

To facilitate providing this relatively close relationship, the upper wheels 24, 26 and lower rollers 25, 27 are all of smaller diameter (9, 8.8, 18 and 8.4 mm respectively) than the most-nearly analogous elements of the prior apparatus discussed above. Thus the present invention proceeds in part from a recognition that the priorart system discussed earlier suffered from an excessively long span of printing medium between the drive and tension rollers—at three distinct times during printing of a sheet of medium:

near the head of the sheet, before a leading edge is captured by the tensioning rollers and star wheels, when curling out of plane leads the print medium to strike the star wheels too high and cause a paper jam;

during printing near the center of the medium, where any out-of-plane edge curling at midspan is not controlled ideally for best image quality, and also in particular while that span is unconstrained at the bottom of the page. These problem areas, and hence the improvements provided by the present invention, are all particularly important in view of the use of heating to promote drying. It has already been mentioned that application of heat accentuates deformation out of plane.

Figure 7:
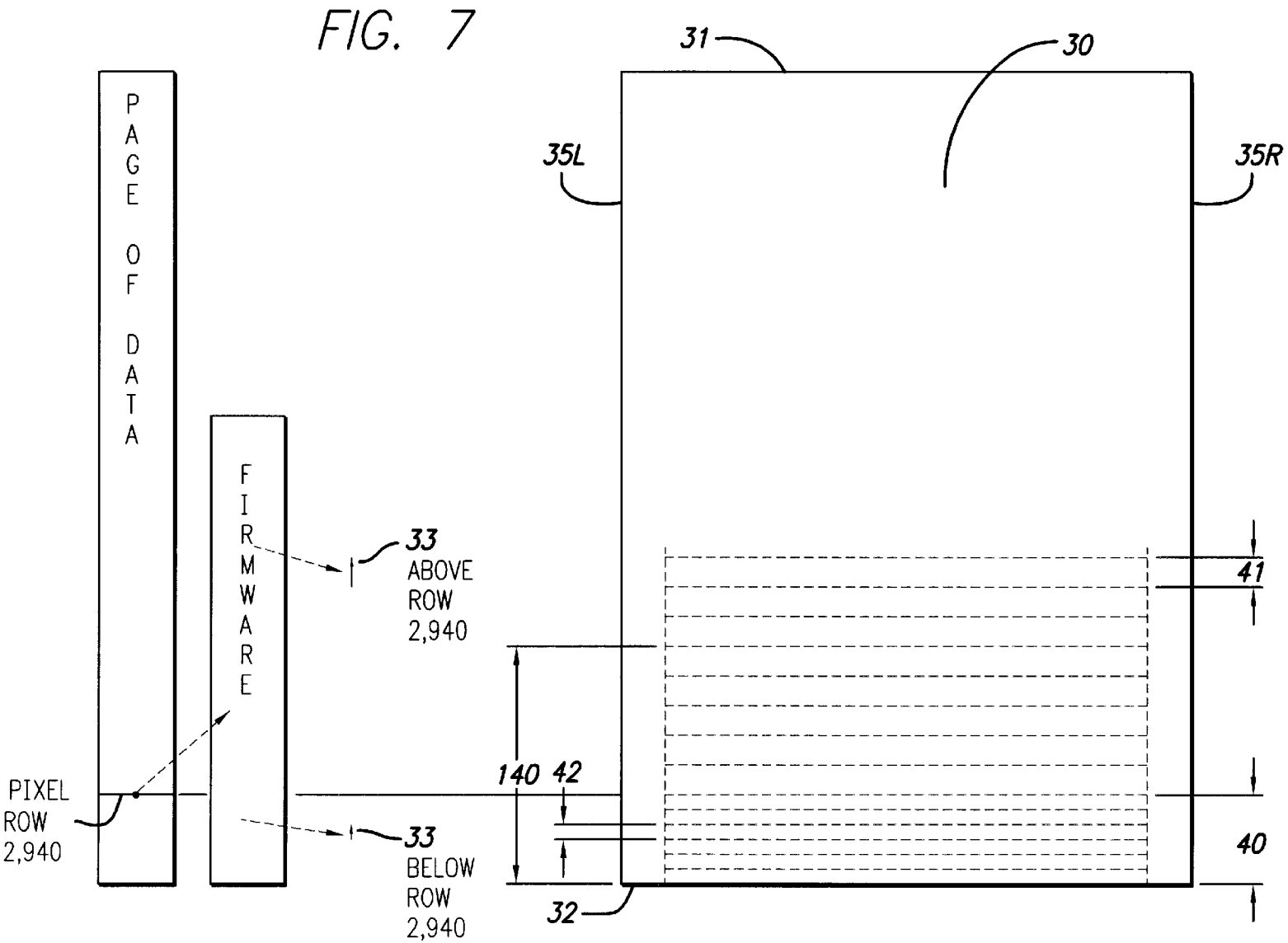
FIG. 7 is a diagram comparing end-of-page regions and advance distances for preferred embodiments of the invention vis-a-vis a typical prior-art system.

As a result of improved dimensioning in accordance with the present invention, the height 40 (FIG. 7) of the end-of-page zone—in which only one set of elements can control the trailing edge 32 of the medium 30—is reduced by a factor of about 2½ (relative to the prior-art zone height 140). This reduction greatly diminishes the objectionable conspicuousness of any banding in that zone.

Furthermore, the distance by which the printing medium advances, even within the shallower end-of-page zone, is reduced by about half—from the standard distance 41 employed above the end-of-page zone (and in the prior art employed over the entire length of the sheet 30) to the special shorter distance 42. The standard distance 41 is preferably the height of thirty-two pixel rows (about one-ninth inch), and the special shorter distance 42 preferably the height of only sixteen rows (one-nine-tenth inch).

In general the advance by only one-nineteenth inch helps hide medium-advance errors within the end-of-page zone. Many images, however, actually terminate about two or three centimeters from the bottom edge of the page; for images that happen to end within the first nineteenth inch at the upper end of the bottom-of-page zone, actually there is no medium-advance error to hide. It is preferred to use three passes for both segments of the page.

3. Media of Different Widths

When media of different widths are loaded into the machine, it is advantageous to shift one or both of the side guides 23L, 23R to maintain the restraints immediately at the edges of the media as diagrammed in FIG. 2. As shown in FIG. 3, a system for performing this function semiautomatically preferably includes a lateral stop 51 for aligning in common one edge of a multiplicity of sheets 30 in a stack 30" of printing-medium sheets.

The system also includes a user-actuable device 52 for selecting printing-medium width—and in particular shifting the stop 51 laterally. A mechanism 53 transmits the user's manual selection to shift the adjacent (here the left-side) hold-down guide 23L as well.

The adjacent guide 23L is thus semiautomatically adjusted for position next to the print zone when the sheets of printing medium are loaded into the printing machine. This arrangement avoids the necessity of adjusting the guide 23L separately. (As mentioned earlier, adjustment of the guide 23L, as well as the stop 51, could be fully automated in response to the width of the stack 30" of printing-medium sheets.)

4. Decreased Advance Near Bottom of Page

The guide system shown in FIGS. 1 through 3—and particularly the side hold-down pair 23L, 23R—restrains print media in and near the print zone so that the printing mechanism does not contact the media during printing or media advancing. Ink smearing, and tearing and folding of the media, are thereby substantially prevented. Top and bottom margin requirements are nevertheless minimal.

In addition the invention substantially prevents print-quality degradation at the bottom of the page—when the tension roller becomes the primary paper driver—without introducing a large tension roller that would force the interroller span to undesirably large values. To put it the other way around, a small tension roller, and therefore short span between rollers, can be used to obtain best print quality near the top of the page and near the center of the page, without sacrificing print quality near the end.

These improvements are accomplished by program detection of data ready for printout below approximately pixel row 2,940—and at that point resetting the number of pixel rows of advance at each step from thirty-two to sixteen. In this way only half the positional error arising from tension-roller tolerances is accrued—and relieved—at each step.

5. Programed Processor and Related Hardware for Implementing the Invention

Figure 8:
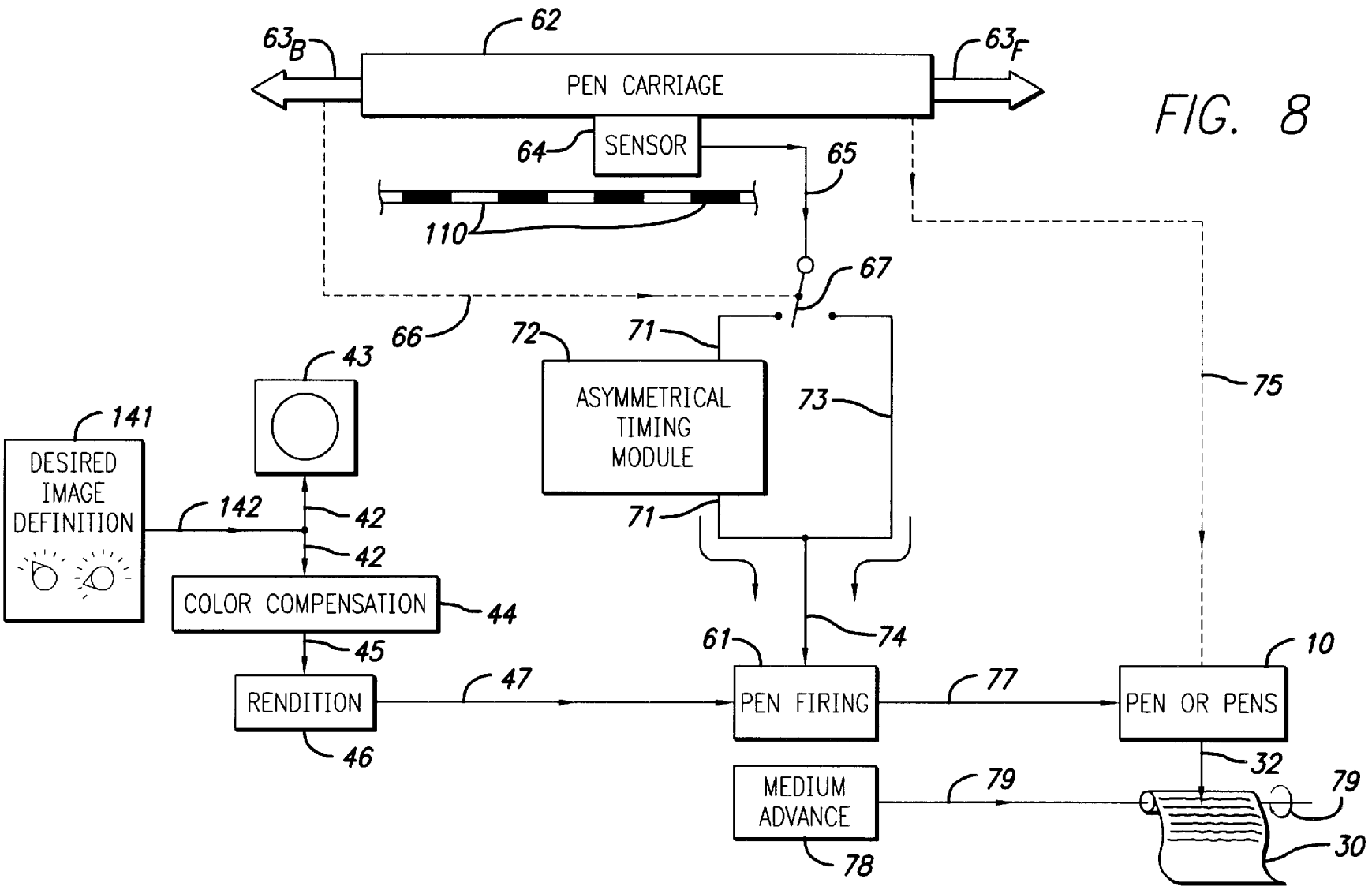
FIG. 8 is a block-diagrammatic representation of a hardware system according to the invention.

FIG. 8 illustrates the general preferred layout of a programmed-microprocessor-based printing machine according to the invention. An input stage 141, which may include manual controls, provides information defining the desired image. The output 142 of this stage may proceed to a display 43 if desired to facilitate esthetic or other such choices; and, in the case of color printing systems, to a color-compensation stage 44 to correct for known differences between characteristics of the display 43 and/or input 141 system vs. the printing system 47-61-10-32-30.

An output 45 from the compensator 44 proceeds next to a rendition stage 46 that determines how to implement the desired image at the level of individual pixel-position printing decisions—for each color, if applicable. The resulting output 47 is directed to a circuit 61 that determines when to direct a firing signal 77 to each pen 10.

The pens discharge ink 32 to form images on paper or some other printing medium 30. Meanwhile typically a medium-advance module 78 provides relative movement 79 of the medium 30 in relation to the pens 10.

In developing its firing-signal determination, the firing circuit 61 must take into account the position of the pen carriage 62, pen mount 75 and pen 10. Such accounting is enabled by operation of an electrooptical sensor 64 that rides on the carriage 62 and reads a code-strip 110.

A timing module 72 is positioned in the line between the sensor 64 and firing circuit 61. The timing module 72 provides for various special positioning functions, including encoder-signal inversion or equivalent, during scanning in one of two directions.

It also provides for backing off by one pulse and then delay in pen firing, also during scanning in one of two directions. Most particularly for purposes of the present invention the timing module 72 switches into use the interpolated, double-frequency positioning signal mentioned above, for use only in printing black on re-trace, when colors are being printed in the alternating forward sweeps. (As noted earlier, this signal is also used in printing black bidirectionally, when colors are not being printed; but in this case the use of the interpolated signal is not switched by the timing module.)

Operation of this timing module 72 thus is not desired at all times, but rather only synchronously with the directional reversals of the carriage 62. Specifically, the timing module 72 is to be inserted during operation in one direction only, and replaced by a straight-through bypass connection 73 during operation in the other direction—in other words, operated asymmetrically—and this is the reason the timing module 72 is labelled in FIG. 1 "asymmetrical".

This synchronous insertion and removal is symbolized in FIG. 8 by a switch 67 which selects between the conventional connection 73 and a timing-module connection 71. This switch 67 is shown as controlled by a signal 66 that is in turn derived from backward motion $\mathbf{63}_B$ of the pen carriage 62.

Thus the switch 67 is operated to select the timing-module connection 71 during such backward motion $\mathbf{63}_B$, and to select the bypass or conventional route 73 during forward motion $\mathbf{63}_F$. This representation is merely symbolic for tutorial purposes; people skilled in the art will understand that the switch 67 may not exist as a discrete physical element, and/or may instead be controlled from the forward motion $\mathbf{63}_F$ and/or—as will much more commonly be the case—can be controlled by some upstream timing signal which also controls in common the pen-carriage motion $\mathbf{63}_B$, $\mathbf{63}_F$. Further the synchronous switch 67 need not be at the input side of the timing module 72 but instead at the output side—where in FIG. 8 a common converging signal line 74 is shown as leading to the firing circuit 61—or may in effect be at both sides.

Use of a system as illustrated in FIG. 8, at least as most naturally interpreted, will result in the encodersignal inversion, the pulse "backing off" step and the firing delay step all being performed during pen motion in the same, common ("backward") direction. This limitation while preferred is not required for successful practice of the invention.

6. Top/Bottom-of-Page Mask Rotation Only

Figures 9A, 9B, 9C, 9D:
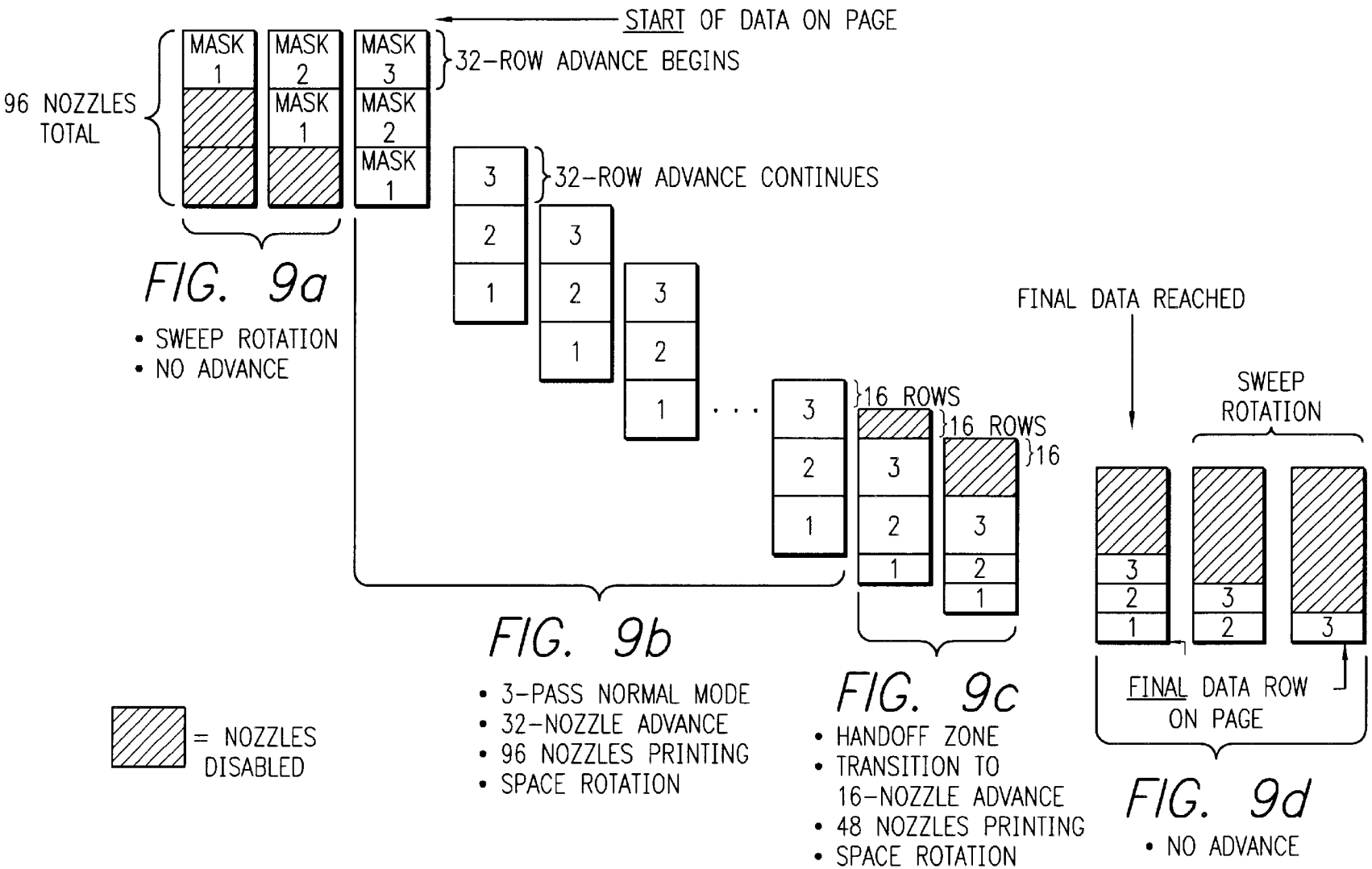
FIGS. 9*a* through 9*d* are diagrammatic print-mask representations of inking patterns used in, respectively: (a) special top-of-page sweep mask rotation to enable suppression of printing-medium advance in that region, (b) midpage space rotation with one-third advance, (c) bottom-of-page handoff space rotation with one-sixth advance, and (d) special bottom-of-page sweep rotation to enable suppression of advance in that region.

At the bottom of each sheet of print medium, a relatively tall region, that may be called the bottom-of-page "handoff" zone, is defined by the distance between sets of rollers that hold the medium taut. As noted earlier in detail, preferably for printing on paper in this region the printing-medium advance height is lowered to half (FIG. 9*c*) its normal midpage value (FIG. 9*b*). For example, in a preferred embodiment each pen has ninety-six nozzles and so makes a ninety-six-pixel swath; the normal advance distance (except for plastic media, per this invention) is one third of this height, or thirty-two pixels—1.33 mm, for a preferred pixel spacing of 1/24 mm (FIG. 9*b*). When the medium cannot be tensioned, as set forth in section 4 above, the advance preferably is halved to sixteen pixels or about 0.7 mm (FIG. 9*c*).

In shallower end zones consisting of the single top (FIG. 9*a*) and bottom (FIG. 9*d*) swaths on each sheet of medium, however, according to the present invention the advance height is reduced to zero—i. e., eliminated entirely. This is done when the pen (or set of pens) is at either end of the data, but most preferably only if that occurs while the medium is untensioned—either in the "handoff" zone or an analogous one at the top.

This operating mode is particularly important when the pen is actually printing along the top or bottom edge of the sheet. Ordinarily good performance is not obtained with the pen skimming partly on and partly off the edge, but space rotation would demand starting or ending in just that condition, to provide three or six passes in a fractional-swath zone along the edge. Under these circumstances, since space rotation can no longer be made to occur, in effect, as a consequence of print-medium advance, it is provided through sweep rotation—changing the inking pattern between pen scans.

On each page preferably the mask is first sweep-rotated on the pen by firmware, for the first two sweeps, while the page is stationary (FIG. 9*a*); then the mask is fixed on the pen and paper advance begins (FIG. 9*b*), producing space rotation—that is, the mask does not change relative to the pen—and most of the page is printed in this normal three-pass mode. In the handoff zone, but not yet at the end of data, the system makes a transition to one-sixth advance, and only half (forty-eight) of the nozzles print, but the mask is still space rotated (FIG. 9*c*). When final data are reached, preferably advance again halts and the remaining two passes are flushed out—with firmware sweep-rotating the mask (FIG. 9*d*).

The above disclosure is intended as merely exemplary, and not to limit the scope of the invention—which is to be determined by reference to the appended claims.

What is claimed is:

1. Apparatus for printing images, by marking with a liquid-base ink, on a web-form printing medium that has a longitudinal direction and two lateral edges; said apparatus comprising:

means for supporting such medium;

a marking head disposed for marking on such medium;

means for engaging such medium and for advancing such medium longitudinally past the marking head;

first guide means for restraining such medium, over an area that is:

upstream, longitudinally, from the marking head, and extended laterally across substantially a full width of such medium except in one or more regions that are laterally near the engagement of the engaging-and-advancing means with such medium;

second guide means for restraining such medium, over an area that is:

disposed laterally from the marking head, and extended laterally across such medium only in one or more regions that are laterally near the engagement of the engaging-and-advancing means with such medium;

means, longitudinally beyond the marking head from the advancing-and-engaging means and generally aligned laterally with the advancing-and-engaging means, for tensioning such medium away from the advancing-and-engaging means to hold such medium substantially taut at the marking head;

wherein such printing medium, when tensioned between the advancing-and-engaging means and the tensioning means, moves stepwise through the apparatus at a normal distance of advance in each step; and further comprising:

means for sensing when a longitudinally rearward edge of such printing medium passes the advancing-and-engaging means so that such printing medium is advanced only by the tensioning means; and means, responsive to the sensing means, for decreasing the distance of advance through the apparatus in each step while such printing medium is advanced only by the tensioning means.

2. The apparatus of claim 1:

wherein the marking head is a thermal-inkjet pen; and further comprising means for scanning the marking head across the supporting means to mark on such medium when supported in the supporting means.

3. The apparatus of claim 1, wherein:

the sensing means comprise a data-detection program; and the distance-decreasing means comprise an advance-distance-resetting program.

4. The apparatus of claim 1, further comprising:

means, longitudinally beyond the marking head from the advancing-and-engaging means and generally aligned laterally with the advancing-and-engaging means, for tensioning such medium away from the advancing-and-engaging means to hold such medium substantially taut at the marking head.

5. The apparatus of claim 4, wherein:

the marking head operates in a print zone;

the advancing-and-engaging means are very closely spaced upstream from the print zone; and the tensioning means are very closely spaced downstream from the print zone.

6. The apparatus of claim 5, wherein:

the advancing-and-engaging means comprise a first wheel that engages the marking surface of such medium and a second wheel that engages the opposite surface of such medium;

the tensioning means comprise a third wheel that engages the marking surface of such medium and a fourth wheel that engages the opposite surface of such medium.

7. The apparatus of claim 6, wherein:

the distance between the centers of the first and third wheels is approximately 13 millimeters greater than the sum of (1) the radius of the first wheel, (2) the radius of the third wheel, and (3) the longitudinal dimension of the print zone.

8. The apparatus of claim 6, wherein:

the sum of the radii of the first and third wheels and the longitudinal dimension of the print zone is approximately 18 millimeters; and the first and third wheels are centered approximately thirty millimeters apart.

9. The apparatus of claim 6, wherein:

the first wheel is a pinch wheel;

the second wheel is a drive wheel;

the third wheel is a star wheel; and the fourth wheel is a tension roller.

10. A method of printing desired images on a printing medium by construction from individual marks formed in pixel arrays by a scanning print head that operates in conjunction with a printing-medium advance mechanism; said method comprising the steps of:

repetitively scanning the print head across the printing medium;

periodically, between repetitions of scanning the print head across the printing medium, operating the printing-medium advance mechanism to advance the medium stepwise by a normal distance at each step;

generally during the scanning and operating steps, tensioning such medium between an advance wheel and a tensioning wheel;

determining when a trailing edge of such printing medium passes the advance wheel so that such printing medium is advanced stepwise only by the tensioning wheel and is no longer tensioned; and responding to the determining step by decreasing the distance of advance through the apparatus, for each step, while such printing medium is advanced only by the tensioning wheel and is no longer tensioned.

11. The method of claim 10 wherein:

said decreasing step comprises reducing the distance of advance, at each said step, to about half the normal distance.

12. The method of claim 10, wherein:

the normal distance of advance is approximately thirty-two pixel rows at each step; and said decreasing step comprises reducing the distance of advance to approximately sixteen pixel rows.

13. The method of claim 10, wherein:

the determining step comprises automatic data detection by a program; and the responding step comprises automatic advance-distance resetting by a program.

14. Apparatus for printing desired images on a printing medium by construction from individual marks formed in pixel arrays; said apparatus comprising:

a scanning printhead;

a printing-medium advance mechanism;

a first program module, operating in a device, that repetitively controls the printhead to scan across such printing medium, and that periodically, between repetitive scans of the printhead, controls the printing-medium advance mechanism to advance the medium stepwise by a normal distance at each step;

an advance wheel;

a tensioning wheel;

a tensioning mechanism that, generally during the repetitive scan and advance controlled by said device, tensions such medium between said two wheels;

a second program module, operating in said device, for determining when a trailing edge of such printing medium passes the advance wheel so that such printing medium is advanced stepwise only by the tensioning wheel and is no longer tensioned; and a third program module, operating in said device, for responding to the determining step by decreasing the distance of advance through the apparatus, for each step, while such printing medium is advanced only by the tensioning wheel and is no longer tensioned.

* * * * *

UNITED STATES PATENT AND TRADEMARK OFFICE

CERTIFICATE OF CORRECTION

PATENT NO. : 6,848,765 B1
DATED : February 1, 2005
INVENTOR(S) : L. Cleveland et al.

It is certified that error appears in the above-identified patent and that said Letters Patent is hereby corrected as shown below:

Title page,
Item [75], Inventors, insert the following:
-- Lance Cleveland
Damon Broder
William C. Hilliard
Aneesa Rahman Scandalis
Gerold G. Firl
Robert R. Giles
Joseph Milkovits --

Signed and Sealed this

Twenty-sixth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,848,765 B1
DATED : February 1, 2005
INVENTOR(S) : Lance Cleveland It is certified that error appears in the above-identified patent and that said Letters Patent is hereby corrected as shown below:

Column 22,
Line 2, after "medium;" insert the following new paragraph -- wherein the first guide means do not engage such medium in any region that is laterally aligned with, or laterally near, the engagement of the engaging-and-advancing means with such medium; and --.
Line 3, after "means for" insert -- contacting and --.
Line 7, after "laterally" insert -- aligned with, or laterally --.
Line 12, after "means, for" insert -- holding such medium in substantially a planar configuration without wrapping around any wheel or the like, and --.

Column 24,
Line 39, add the following claims:

--15. Apparatus for printing images by marking with liquid ink on a medium, comprising:
means for supporting such medium;
a marking head marking such medium;
drive means for engaging such medium and advancing such medium past the head;
guide means for restraining such medium over an area upstream from the head;
means, beyond the head from the drive means, for tensioning such medium away from the drive means to hold such medium substantially taut at the head;
wherein such medium, when tensioned between the drive means and tensioning means, moves stepwise at a normal distance of advance in each step;
means for sensing when an edge of such medium passes the drive means so that such medium is advanced only by the tensioning means; and
means, responsive to the sensing means, for decreasing the advance in each step during advance by only the tensioning means.

16. The apparatus of claim 15, wherein the tensioning means comprise:
means for holding such medium in substantially a planar configuration, without wrapping around any wheel in a region near the head.

17. The apparatus of claim 16, wherein:
the guide means are extended laterally across substantially a full width of such medium except in one or more regions laterally aligned with, or laterally near, points of engagement of the drive means with such medium.

18. The apparatus of claim 17, further comprising:
second guide means for contacting and restraining such medium over an area disposed laterally from the head;
said second guide means being extended laterally across such medium only in one or more regions laterally aligned with, or laterally near, points of engagement of the drive means with such medium.

UNITED STATES PATENT AND TRADEMARK OFFICE

CERTIFICATE OF CORRECTION

PATENT NO. : 6,848,765 B1
DATED : February 1, 2005
INVENTOR(S) : Lance Cleveland It is certified that error appears in the above-identified patent and that said Letters Patent is hereby corrected as shown below:

Column 24 (cont'd),

19. Apparatus for printing images on a printing medium by construction from marks formed in arrays; said apparatus comprising:

a scanning printhead;

a printing-medium advance mechanism;

a first program module, operating in a device, that repetitively controls the printhead to scan across such medium, and periodically, between repetitive scans of the printhead, controls the mechanism to advance such medium stepwise by a normal distance at each step;

an advance wheel;

a tensioning wheel;

a tensioning mechanism that, generally during the repetitive scan and advance controlled by said device, tensions such medium between said two wheels;

a second program module, operating in said device, for determining when a trailing edge of such medium passes the advance wheel so that such medium is advanced stepwise only by the tensioning wheel and is no longer tensioned; and a third program module, operating in said device, for responding to the determining step by decreasing the distance of advance through the apparatus, for each step, while such medium is advanced only by the tensioning wheel and is no longer tensioned.--

Signed and Sealed this

Twenty-fourth Day of January, 2006

JON W. DUDAS
*Director of the United States Patent and Trademark Office*